US005706608A

United States Patent [19]

Sweet

[11] Patent Number: 5,706,608

[45] Date of Patent: Jan. 13, 1998

[54] GUTTER WITH CURLED RETAINING FLANGE AND METHOD OF FORMING

[76] Inventor: Vernon L. Sweet, 6363 Douglas Rd., Lambertville, Mich. 48144

[21] Appl. No.: 628,864

[22] Filed: Apr. 5, 1996

[51] Int. Cl.[6] ..... E04D 13/00

[52] U.S. Cl. ..... 52/11; 248/18.2

[58] Field of Search ..... 52/11, 13, 15; 248/48.2

[56] References Cited

U.S. PATENT DOCUMENTS

| | | |
|---|---|---|
| 2,175,521 | 10/1939 | Fry . |
| 2,209,741 | 7/1940 | Sullivan et al. . |
| 3,067,881 | 12/1962 | Goosmann . |
| 3,351,206 | 11/1967 | Wennerstrom . |
| 4,907,381 | 3/1990 | Ealer . |

OTHER PUBLICATIONS 2-page sales flyer for Knudson Half-Round Gutter Machine, Model HR-300.

*Primary Examiner*—Creighton Smith
*Attorney, Agent, or Firm*—MacMillan, Sobanski & Todd

[57] ABSTRACT

A gutter for a building includes a longitudinal body having a central concave channel, a front edge and a rear edge. The concave channel defines inner and outer surfaces. A curled retaining flange is formed along the front edge and defines inner and outer surfaces. A transition portion is formed at the intersection of the concave channel and the retaining flange. Tangents of the outer surfaces of the concave channel and the retaining flange originating at the transition portion form an acute angle. If desired, a roof flange can be formed along the rear edge of the longitudinal body.

20 Claims, 2 Drawing Sheets

GUTTER WITH CURLED RETAINING FLANGE AND METHOD OF FORMING

BACKGROUND OF THE INVENTION

1. Field of the Invention

This invention relates generally to gutters for buildings, and in particular is concerned with a gutter having a curled retaining flange and a method for forming such a gutter.

2. Description of the Related Art

Gutters for buildings are well known. In general, gutters are open horizontal channels secured to an exterior wall adjacent eaves or to the roof of a building to carry off rain water. The gutters can be connected to closed vertical conduits, commonly referred to as downspouts, drainspouts or conductors, to direct water to a drain or to the ground away from a building. Mitres and elbows are commonly used to connect gutters and downspouts.

A gutter includes a channel or trough which receives and directs water. Popular cross sections or configurations for gutters include generally rectangular and semi-circular designs, the later of which is referred to as a half round gutter. Oftentimes, a retaining flange is formed along a front edge of the channel to receive a hanger for attaching the gutter to a mounting surface.

Modern gutters can be formed by bending a coiled strip of material to a desired profile and cutting the strip to a desired length. Popular materials for gutters include aluminum, copper and steel. A strip can be bent by a machine having a series of rollers to produce the desired profile. Such a machine is commonly referred to as a rollformer.

The art continues to seek improvements. It is desirable to form a gutter from a strip of material painted on only one surface. After the strip has been bent to a desired configuration, only painted surfaces are visible to an observer at ground level. Furthermore, it is desirable to form a half round gutter with a curled or rounded retaining flange to produce a desired and appealing design.

SUMMARY OF THE INVENTION

This invention relates to a gutter for buildings and a method for forming such a gutter. The gutter includes a rounded channel having a curled or rounded retaining flange to provide a desired and appealing design. The gutter can be formed from a strip of material painted on only one surface. After the strip has been bent to the desired profile, only painted surfaces are visible to an observer at ground level. Furthermore, a gap between the retaining flange and the rounded channel is not visible to an observer at ground level when the gutter is mounted on a building.

In a preferred embodiment, a gutter for a building includes a longitudinal body having a central concave channel, a front edge and a rear edge. The concave channel defines inner and outer surfaces. A curled retaining flange is formed along the front edge and defines inner and outer surfaces. A transition portion is formed at the intersection of the concave channel and the retaining flange. Tangents of the outer surfaces of the concave channel and the retaining flange originating at the transition portion form an acute angle. If desired, a roof flange can be formed along the rear edge of the longitudinal body.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
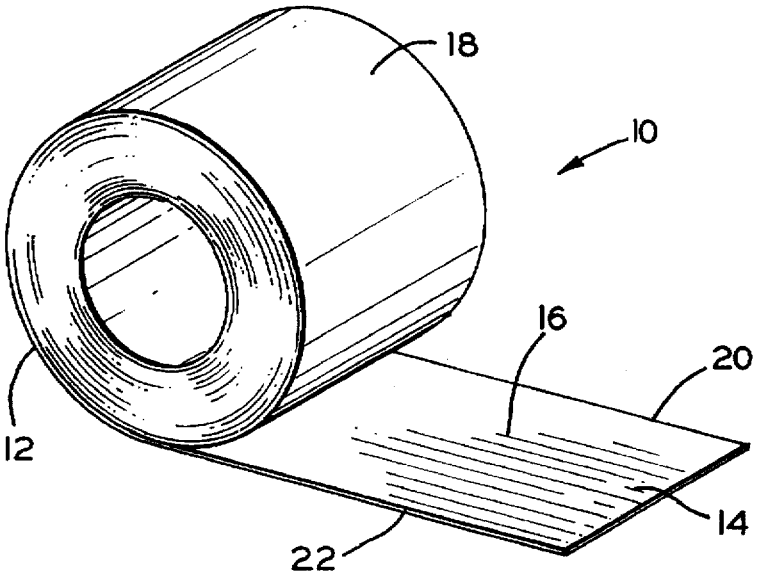
FIG. 1 is a perspective view of a gutter coil used to make gutters for buildings.

A gutter coil is indicated generally at 10 and illustrated in FIG. 1. The gutter coil 10 includes a strip 12 of material of a predetermined length adapted to be rolled onto a spool (not illustrated) or the like. The strip 12 can be formed from any desired material including aluminum, copper, and steel, which is bendable, plastically deformable and suitable for gutters. The strip 12 is formed with a desired thickness (gauge) and width.

As the strip 12 is unwound, a leading flat length 14 includes an inner surface 16, an outer surface 18, a front edge 20, and a rear edge 24. The flat length 14 can be received by a gutter rollformer (not illustrated) and bent and deformed to a desired profile to form a gutter. Once a desired length is obtained, the formed length is cut from the remainder of the strip 12 and mounted at the roof line of a building in well known manners. Also, a desired length of the strip 12 can be cut to form a flat blank (not illustrated). Such a flat blank can be bent and deformed to form a gutter of a desired profile.

Figure 2:
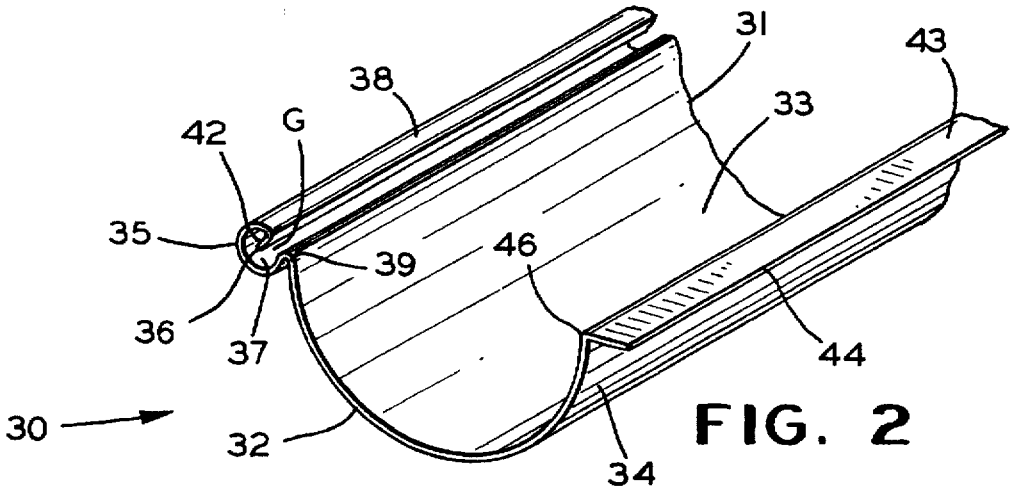
FIG. 2 is a perspective view of a gutter according to the present invention illustrating a curled retaining flange.
Figure 3:
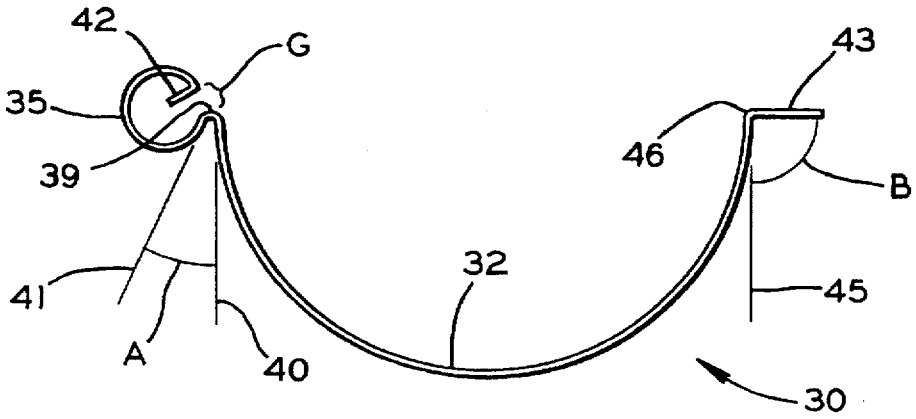
FIG. 3 is a schematic profile of the gutter of FIG. 2.

A preferred embodiment of a gutter according to the present invention is indicated generally at 30 and illustrated in FIGS. 2 and 3. The gutter 30 includes a longitudinal body 31 having a concave channel or trough 32 which carries water in a well known manner. The concave channel defines a curved or rounded inner surface 33 and a curved or rounded outer surface 34. Preferably, the channel 32 is formed along a substantially constant radius spanning approximately 180 degrees. Gutter 30 may be referred to as a type of half round gutter because of the concave channel 32. The concave channel 32 can be formed as desired with respect to the width of the gutter 30.

A curled or rounded retaining flange 35 is formed along a front edge of the concave channel 32. The retaining flange 35 is preferably formed along a substantially constant radius spanning approximately 270 degrees. The radius of the retaining flange 35 is preferably significantly smaller than the radius of the concave channel 32. For example, in one embodiment of the gutter 30 the radius of the retaining flange 35 is approximate five-eighths (⅝) of an inch, while the radius of the concave channel 32 is approximately seven (7) inches. The retaining flange 35 defines an inner curved or rounded surface 37 and an outer curved or rounded surface 38.

A transition portion 39 is formed at the intersection of the concave channel 32 and the retaining flange 35. A tangent 40 to the channel outer surface 32 and originating at the transition portion 39 is illustrated in FIG. 3. A tangent 41 to the flange outer surface 38 and originating at the transition portion 39 forms an angle A with tangent 40. Preferably, angle A is an acute angle (less than 90 degrees). Such configuration produces the desired appearance of the retaining flange 35 relative to the concave channel 32. A gap G between the transition portion 39 and the curled outer surface 38 of the retaining flange 35 is not visible to an observer at ground level when the gutter 30 is mounted.

The retaining flange 35 preferably terminates in a non-curled hem 42 ending at a front edge 36. Preferably the hem 42 can be bent to any desired orientation.

A roof flange 43 can be formed along a rear edge 44 of the gutter 30. The roof flange 43 is preferably flat and is formed with a desired width. An angle B is formed between the roof flange 43 and a tangent 45 of the concave channel 32 taken at the intersection 46 of the concave channel 32 and the roof flange 43. Angle B can range between an acute angle and an obtuse angle as desired. When the gutter 30 is mounted on a building, the roof flange 43 can be inserted beneath shingles or the like and secured with suitable fasteners. While gutter 30 has been illustrated with a roof flange 43, other embodiments of the present invention can be formed without a roof flange 43.

Figure 4:
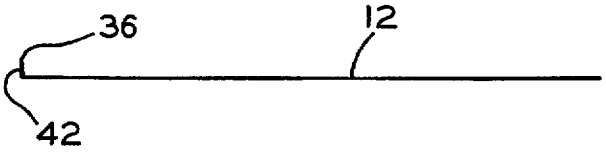
FIGS. 4–12 illustrate schematic profiles of a strip from the gutter coil of FIG. 1 bent in successive steps to form the profile of the gutter illustrated in FIGS. 2 and 3.

The successive steps of forming gutter 30 from the strip 12 are illustrated in the schematic profiles of FIGS. 4–12. FIG. 4 illustrates the profile of the strip 12 after a first bending operation wherein the hem 42 is formed at the front edge 36. At this early stage, the hem 42 is vertical and substantially perpendicular to the balance of the strip 12. Also, the hem 42 is relatively short in height when compared to the remaining width of the strip 12.

Figure 5:
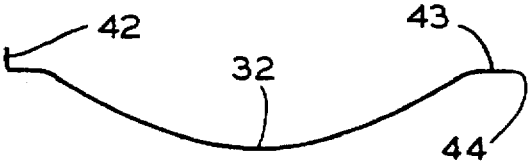
Figure 6:
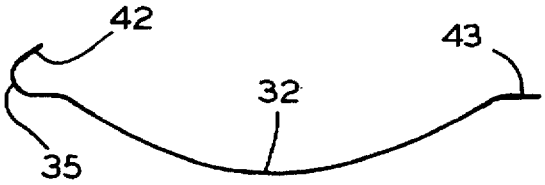

FIG. 5 illustrates the profile of the strip 12 after a second bending operation which forms a preliminary shallow concave channel 32 in the central portion of the strip 12 and the roof flange 43 along the rear edge 44. FIG. 6 illustrates the profile of the strip 12 after a third bending operation which deepens the concave channel 32 and begins to form the curled retaining flange 35. At this stage, the hem 42 is angled away from its vertical orientation of FIGS. 4 and 5.

Figure 7:
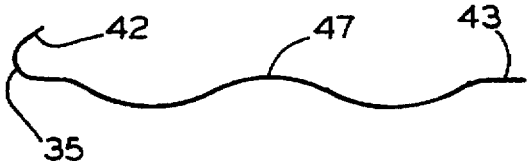

FIG. 7 illustrates the profile of the strip 12 after a fourth bending operation. The concave channel 32 has been bent or deformed in the opposite direction near a midpoint of the concave channel 32 so as to form a convex hump 47 in the concave channel 32.

Figure 8:
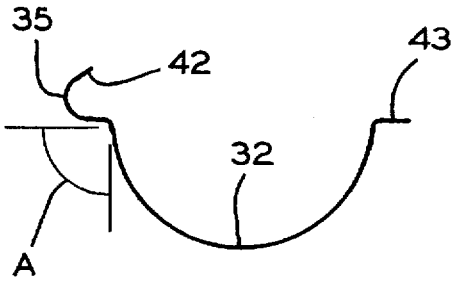

FIG. 8 illustrates the profile of the strip 12 after a fifth bending operation. The concave channel 32 has been bent back to a provide a deeper concave profile than the profile of FIG. 6. The convex hump 47 of FIG. 7 has been eliminated. The steps illustrated in FIGS. 7 and 8 assist the gutter 30 in retaining its final concave channel 32. Furthermore, angle A of the associated tangents is at approximately a right angle.

Figure 9:
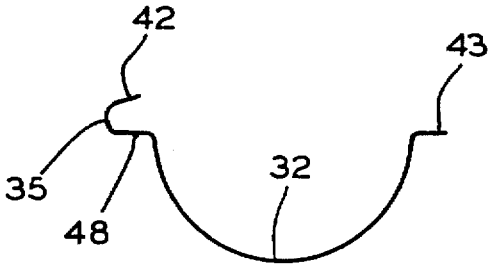

FIG. 9 illustrates the profile of the strip 12 after a sixth bending operation. A portion of the retaining flange 35 adjacent angle A is formed with a substantial horizontal section 48.

Figure 10:
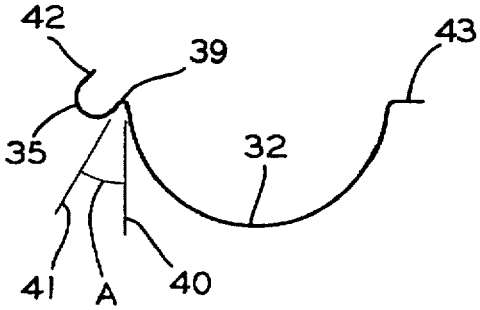

FIG. 10 illustrates the profile of the strip 12 after a seventh bending operation eliminates the horizontal section 48 illustrated in FIG. 9 and forms an acute angle A between the tangents 40 and 41 adjacent the transition portion 39.

Figure 11:
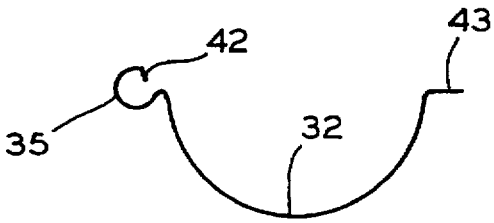

FIG. 11 illustrates the profile of the strip 12 after an eighth bending operation. The retaining flange 35 has been further curled to roll the hem 42 inwardly.

Figure 12:
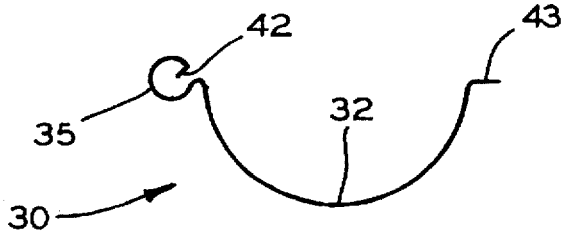

FIG. 12 illustrates the profile of the strip 12 in a finished state after a ninth bending operation. The hem 42 has been bent to a desired orientation. At this point, the strip 12 has completed the bending steps and forms the desired profile of gutter 30.

It will be appreciated that some of the bending steps illustrated in FIGS. 4–12 can be combined to produce the desired profile in fewer steps. Likewise, it will also be appreciated that some the bending steps illustrated in FIGS. 4–12 can be performed in additional steps to produce the desired profile for gutter 30.

The gutter 30 when formed following the method illustrated in FIGS. 4–12 can be formed from a strip 12 painted on only one surface. The outer surface of strip 12 can be painted a desired color. When the gutter 30 is completed, only the outer surface 34 of the concave channel 32 and the outer surface 38 of the retaining flange 35 are visible to a viewer at ground lever.

When a joint is formed by two sections of gutter 30, the adjacent ends of hem 42 of each section can be slid with respect to one another as one section is telescoped within the other section. Thus, the final orientation of the hem 42 of gutter 30 provides a desirable support for a joint. Furthermore, the orientation 42 can be set so that the hem 42 and/or the retaining flange 35 cooperate with a conventional hanger (not illustrated) to mount the gutter 30.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A gutter adapted to be mounted on a building comprising:

a longitudinal body having a central concave channel, a front edge, and a rear edge, the concave channel defining an inner surface and an outer surface;

an outwardly curled retaining flange formed along the front edge of the concave channel, the retaining flange defining an inner surface and an outer surface and terminating in a front edge;

a transition portion formed at the intersection of the concave channel and the retaining flange, wherein tangents of the outer surfaces of the concave channel and the retaining flange originating at the transition portion form an acute angle; and a gap formed between the transition portion and the front edge of the retaining flange such that the gap and the inner surface of the retaining flange are not visible from the ground when the gutter is mounted on a building.

2. The gutter defined in claim 1 wherein the concave channel has a substantially constant radius.

3. The gutter defined in claim 1 wherein the concave channel spans approximately one hundred eighty degrees.

4. The gutter defined in claim 1 wherein the retaining flange has a substantially constant radius.

5. The gutter defined in claim 1 wherein the retaining flange spans approximately two hundred seventy degrees.

6. The gutter defined in claim 1 wherein the retaining flange terminates in a non-curled hem.

7. The gutter defined in claim 1 including a roof flange formed along the rear edge.

8. The gutter defined in claim 1 wherein only the outer surfaces of the concave channel and the retaining flange are painted.

9. A gutter adapted to be mounted on a building comprising:

a longitudinal body having a central concave channel, a front edge, and a rear edge, the concave channel defining an inner surface and an outer surface;

an outwardly curled retaining flange formed along the front edge of the concave channel and terminating in a front edge, the retaining flange spanning approximately two hundred seventy degrees so that a gap is formed between the front edge of the retaining flange and the front edge of the concave channel, the retaining flange defining an inner surface and an outer surface; and a transition portion formed at the intersection of the concave channel and the retaining flange.

10. The gutter defined in claim 9 wherein tangents of the outer surfaces of the concave channel and the retaining flange originating at the transition portion form an acute angle.

11. The gutter defined in claim 9 wherein the concave channel has a substantially constant radius.

12. The gutter defined in claim 9 wherein the concave channel spans approximately one hundred eighty degrees.

13. The gutter defined in claim 9 wherein the retaining flange has a substantially constant radius.

14. The gutter defined in claim 9 wherein the retaining flange terminates in a non-curled hem.

15. The gutter defined in claim 9 including a roof flange formed along the rear edge.

16. The gutter defined in claim 9 wherein only the outer surfaces of the concave channel and the retaining flange are painted.

17. A method for forming a gutter adapted to be mounted on a building comprising:

(a) providing a strip of bendable material having a central portion, an inner surface, an outer surface, a front edge, and a rear edge;

(b) bending a hem along the front edge;

(c) bending a longitudinal concave channel in a central portion of the strip;

(d) bending an outwardly curled retaining flange terminating in a front edge between the hem and the concave channel so that an acute angle is formed by tangents originating at an intersection of the concave channel and the retaining flange to outer surfaces of the concave channel and the retaining flange and a gap is formed between the front edge of the retaining flange and the front edge of the concave channel.

18. The method defined in claim 17 wherein the longitudinal concave channel is formed by:

bending the central portion of the strip to form a shallow concave channel;

bending the central portion in an opposite direction to form a convex hump near a midpoint of the concave channel; and rebending the central portion to eliminate the convex hump and deepen the concave channel.

19. The method defined in claim 17 wherein prior the bending steps, the method includes the step of painting only the outer surface of the strip.

20. The method defined in claim 17 wherein the retaining flange is bent at a substantially constant radius spanning approximately two hundred seventy degrees.

* * * * *